US007334672B2

(12) United States Patent
Sheehan et al.

(10) Patent No.: US 7,334,672 B2
(45) Date of Patent: Feb. 26, 2008

(54) METHOD FOR DETECTING FAULTS IN A COMBPLATE AND SENSOR COMBPLATE

(75) Inventors: John R. Sheehan, Jamison, PA (US); Paul J. Gandolfo, Doylestown, PA (US); Lou Filo, Hatfield, PA (US)

(73) Assignee: Motor Drives & Controls, Inc., Hatfiled, PA (US)

( * ) Notice: Subject to any disclaimer, the term of this patent is extended or adjusted under 35 U.S.C. 154(b) by 0 days.

(21) Appl. No.: 11/503,743

(22) Filed: Aug. 14, 2006

(65) Prior Publication Data

US 2007/0137979 A1 Jun. 21, 2007

Related U.S. Application Data

(60) Provisional application No. 60/707,740, filed on Aug. 12, 2005.

(51) Int. Cl.
*B66B 25/00* (2006.01)

(52) U.S. Cl. ..... 198/323; 198/325

(58) Field of Classification Search ..... 198/323, 198/325, 329, 333
See application file for complete search history.

(56) References Cited

U.S. PATENT DOCUMENTS 3,233,717 A * 2/1966 Jin et al. ..... 198/323
4,362,232 A * 12/1982 Saito et al. ..... 198/333
4,756,398 A * 7/1988 Watanabe et al. ..... 198/324
4,800,998 A * 1/1989 Myrick ..... 198/323
5,255,771 A * 10/1993 Nurnberg et al. ..... 198/323
5,718,319 A * 2/1998 Gih ..... 198/323
6,283,270 B1 9/2001 Robibero et al.
6,520,310 B1 * 2/2003 Lauch et al. ..... 198/323
6,644,457 B2 * 11/2003 Lauch ..... 198/322
6,966,419 B2 * 11/2005 Tada ..... 198/323

* cited by examiner

*Primary Examiner*—Douglas A Hess
(74) *Attorney, Agent, or Firm*—Volpe and Koenig, PC

(57) ABSTRACT

A combplate closes the terminal ends of a continuous belt transport system having grooved carrier plates. The combplate has a plurality of protrusions and a communications board. The plurality of spaced apart projections are located along the one lateral edge with a portion thereof extending forward of the one lateral edge, shaped to align with and pass between the carrier plate grooves, and provided with a detector that senses a break in its integrity and a circuit for communicating its status externally. The communications board is in electrical contact with each of the projections for repeatedly monitoring the status of each projection to detect a break in a projection's integrity.

24 Claims, 8 Drawing Sheets

METHOD FOR DETECTING FAULTS IN A COMBPLATE AND SENSOR COMBPLATE

RELATED APPLICATION

This application claims priority to U.S. Provisional Application No. 60/707,740 filed Aug. 12, 2005.

FIELD OF INVENTION

The field of the invention is continuous belt transport systems, such as escalators and moving sidewalks, and relates particularly to combplates that serve as the threshold between moving plates and stationary landings.

BACKGROUND

FIGS. 1 and 2 show continuous belt transport systems that are typically formed from mated carrier plates 102, for a moving sidewalk 100, and carrier steps 202, for an escalator 200. A motor drives the plates 102 and steps 202 in a continuous loop between stationary landings 104, 204. Due to the high traffic on such transport systems, the plates 102 and steps 202 are sturdy, and usually made from steel or cast aluminum, both of which can be heavy. Moving this weight and riders requires a powerful motor.

The powerful motor creates a potential safety hazard, however. At the landings 104, 204, the plates 102 and stairs 202 descending in the continuous loop create a gap between the landings 104, 204 and the last plate 102 or step 202. This gap can catch trash, shoe laces, pointed heels, purse and backpack straps, or even a person's finger or toe. Any of these events could hurt a passenger or damage the escalator.

As a solution to this problem, a combplate serves as the threshold between the landing 104, 204 and the moving stairs 202 or plate 102. The combplate has elongated teeth or fingers, as shown in U.S. Pat. No. 5,718,319, that extend into corresponding grooves in the plates 102 and stairs 202. These fingers discourage objects from being trapped in the gap between the landings 104,204 and last plate 102 or step 202, but due to their location, the teeth/fingers are often damaged by shoes, carts, trash, and misaligned stairs. When this happens, an even more unsafe condition occurs, because the broken teeth/fingers create sharp edges and open spaces where objects can become lodged.

To overcome these problems, plastic combplates with integral plastic teeth/fingers may be used in the threshold area. These plastic combplates have the advantage that they are less expensive to manufacture and replace than cast or machined steel or aluminum, and they provide a cavity for an electronic detection system that detects a finger break and shuts off the motor in response.

Known plastic combplates with integral teeth also have problems. The teeth are weaker and more susceptible to breaking than metal. The circuits within such teeth are expensive to manufacture. And using a single piece plate-and-teeth assembly makes for an expensive replacement because when a tooth breaks, the entire combplate threshold must be replaced.

SUMMARY

The method and combplate described herein overcome these problems. The combplate closes the terminal ends of a continuous belt transport system comprised of grooved carrier plates. The combplate has an elongated body, a plurality of protrusions, and a communications board. The elongated support body has first and second lateral edges, top and bottom surfaces, and an elongated recess formed in the bottom surface adjacent to one of the lateral edges and a portion opposite the one lateral edge for attaching the plate to a transport system. The plurality of spaced apart projections are located along the one lateral edge with a portion thereof extending forward of the one lateral edge, shaped to align with and pass between the carrier plate grooves, and provided with a detector that senses a break in its integrity and a circuit for communicating its status externally. The communications board is located within the recess and in electrical contact with each of the projections for repeatedly monitoring the status of each projection to detect a break in a projection.

BRIEF DESCRIPTION OF THE DRAWING(S)

DETAILED DESCRIPTION OF THE PREFERRED EMBODIMENT(S)

The invention is applicable to continuous belt transport systems, including moving sidewalks and escalators. However, as escalators are more common, the invention will be described with reference to an escalator; it being understood that the invention would be usable with transport systems other than an escalator.

Figure 1:
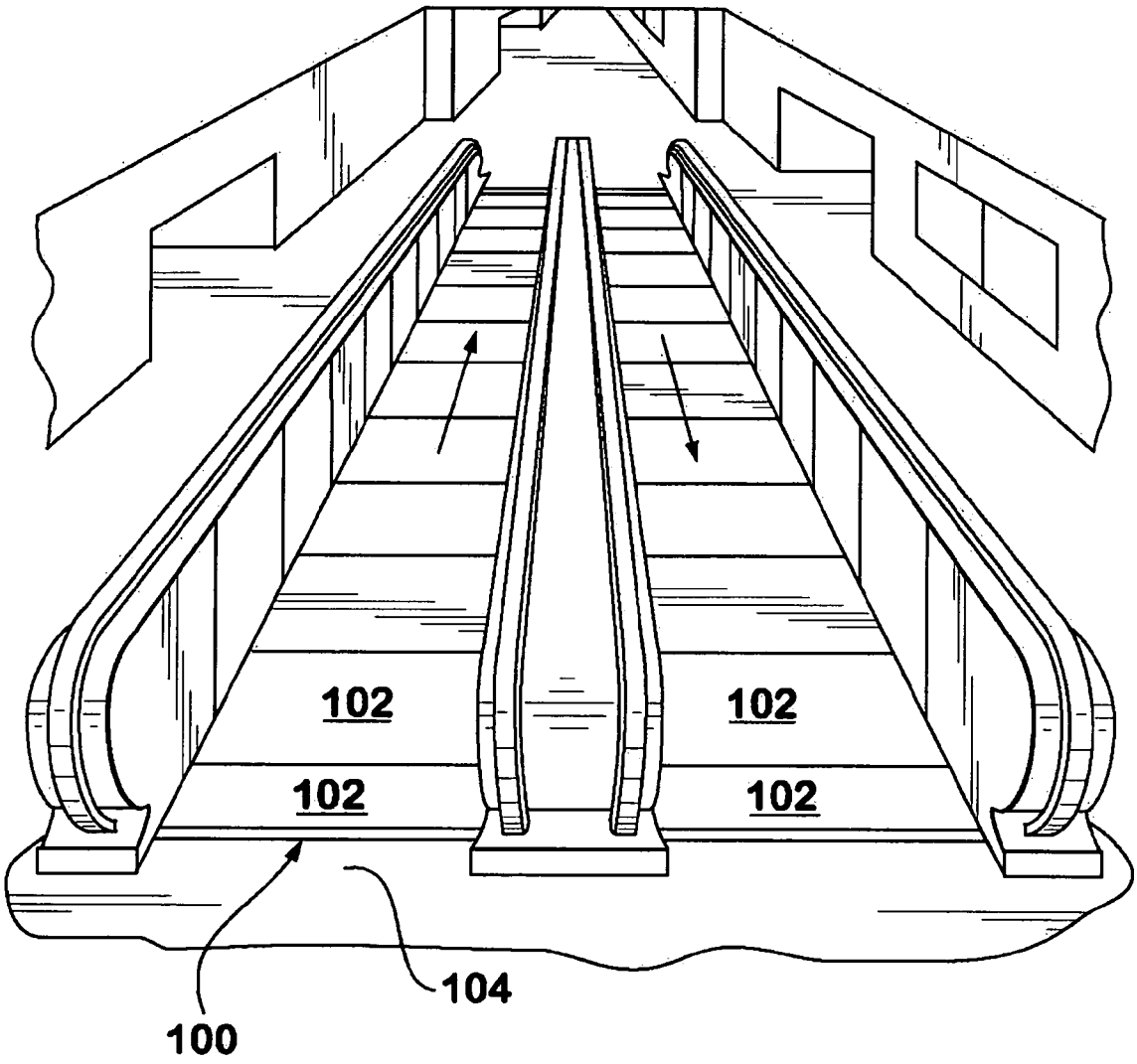
FIG. 1 (PRIOR ART)
FIG. 1 illustrates a prior art moving sidewalk.
Figure 2:
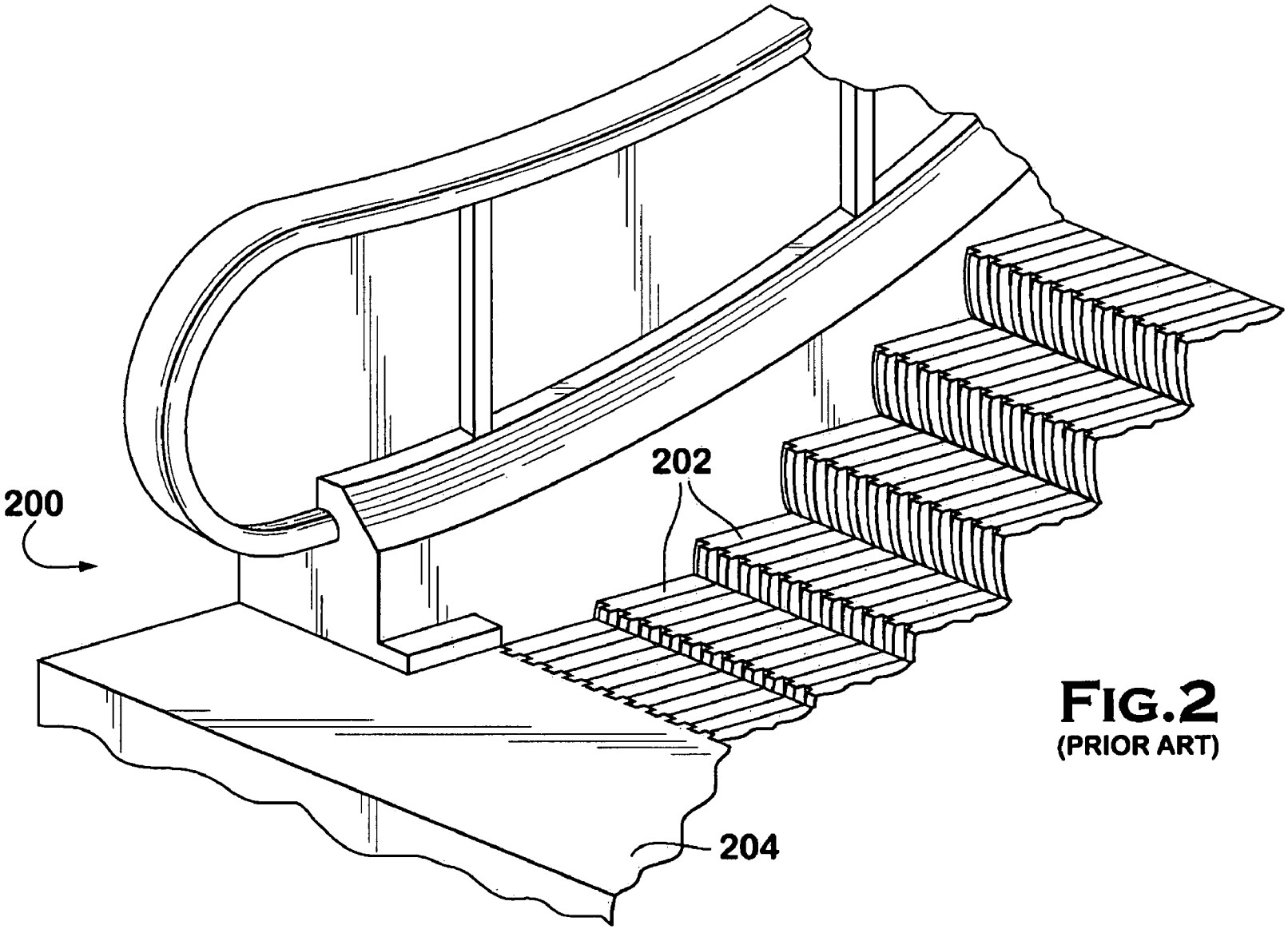
FIG. 2 (PRIOR ART)
FIG. 2 illustrates a prior art escalator.
Figures 3, 3A:
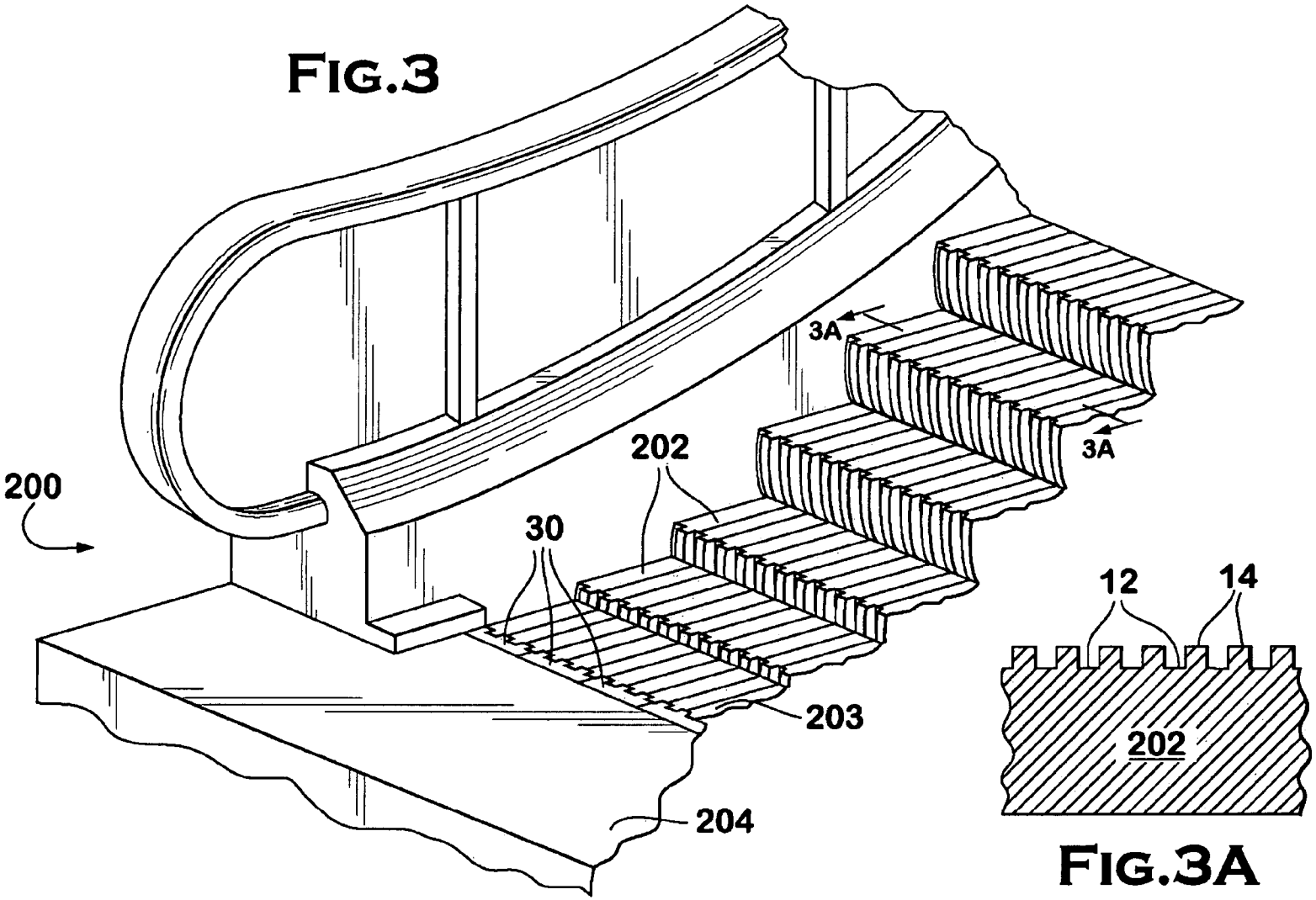
FIG. 3 is an isometric view of the inventive combplate located on an escalator.
FIG. 3A is a partial cross-section through one of the steps of the escalator in FIG. 3.

FIG. 3 shows a plurality of linked combplates 30 that cover the gap between the bottommost stair 203 and the landing 204. Each combplate 30 comprises the components shown in FIG. 4: a support plate 40, a plurality of projections or teeth 60, and a communications circuit board 80.

Figure 4:
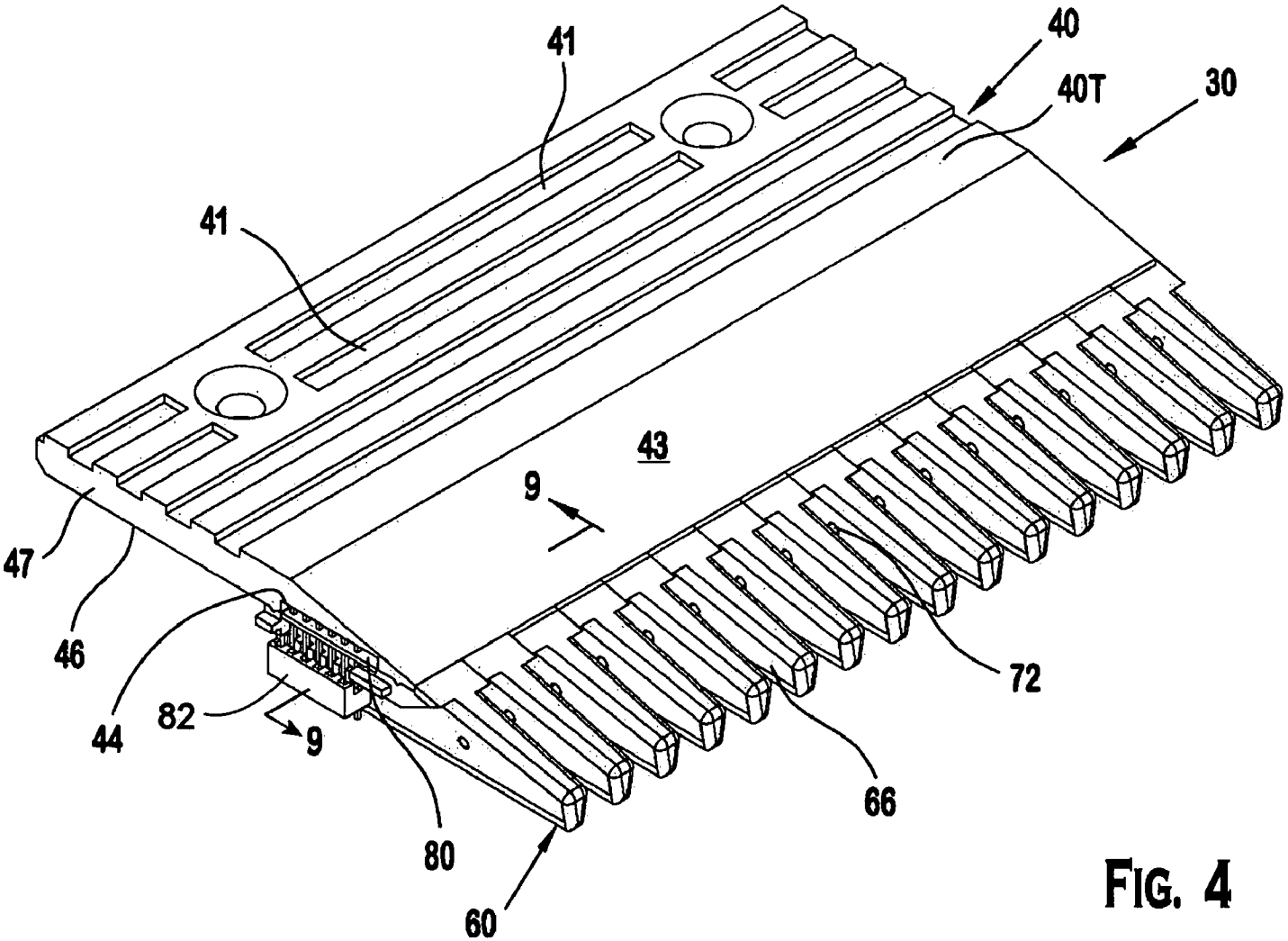
FIG. 4 is an isometric view of the inventive combplate.
Figure 6:
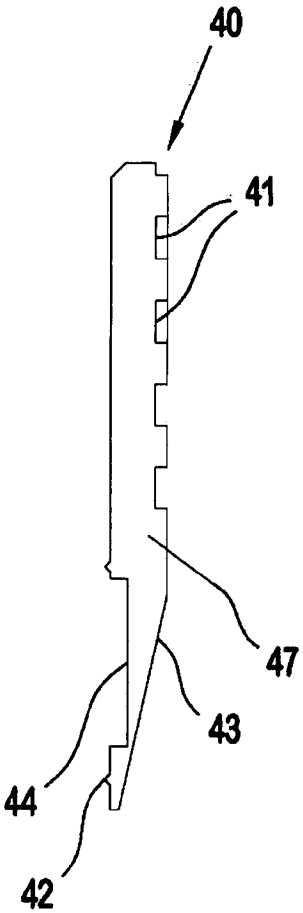
FIG. 6 is a left side view of the support plate shown in FIG. 5.
Figure 5:
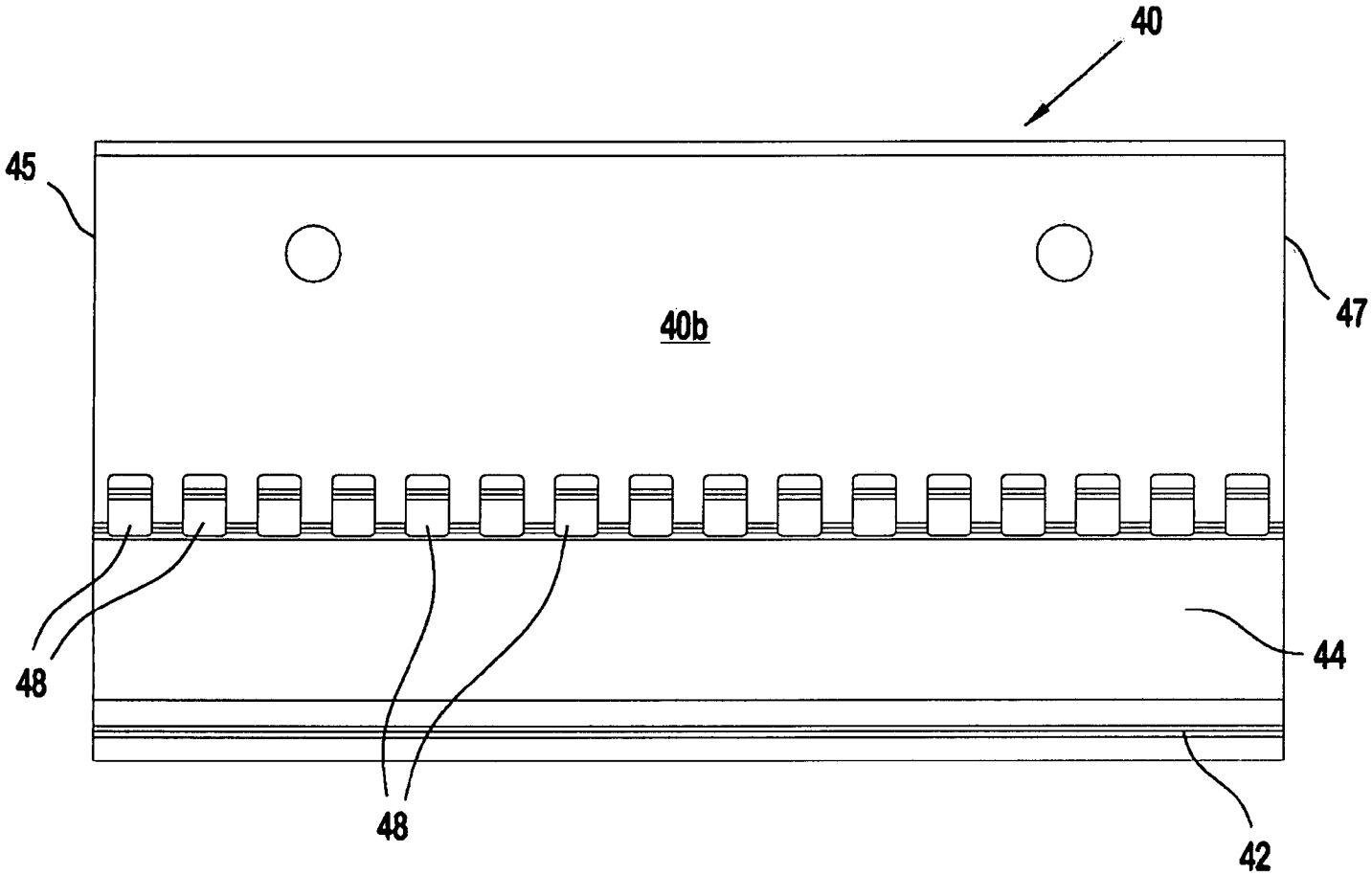
FIG. 5 is a bottom view of the support plate used with the inventive combplate.

FIGS. 4-6 show features of the support plate 40, which has a top surface 40T a bottom surface 40B, and lateral edges 45 and 47. The top surface 40T has grooves 41 that run perpendicular to the direction of travel of the steps 202. The grooves provide a traction point for people's shoes as they leave the escalator 200. The top surface 40T further has a sloped portion 43 that acts as a small wedge to urge a person's foot upwards without tripping them as they make the transition form the moving bottommost step 203 to the landing 204.

As seen from the bottom view of FIG. 5, a recess or channel 44 extends between the lateral edges 45 and 47. This recess 44 is shaped to hold the communications circuit board 80, while slots 48 receive a portion of the teeth or projections 66. An energy director 42 assists in welding the teeth 60 firmly to the plate 40.

Figure 7:
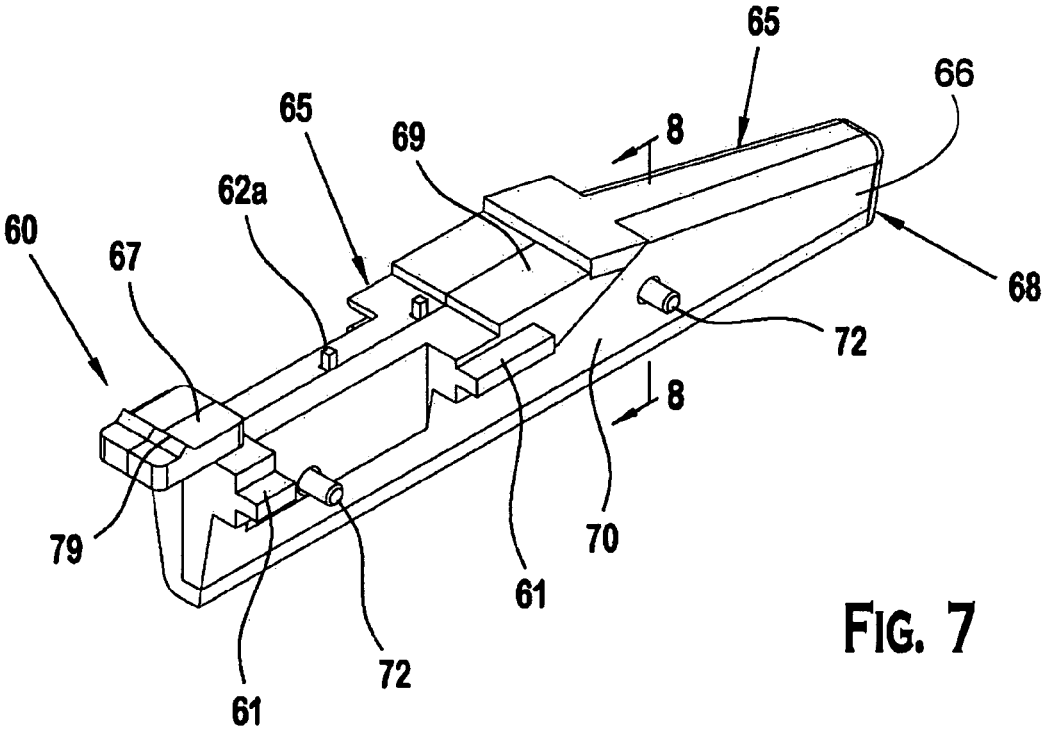
FIG. 7 is an isometric view of a tooth used with the inventive combplate.
Figure 8:
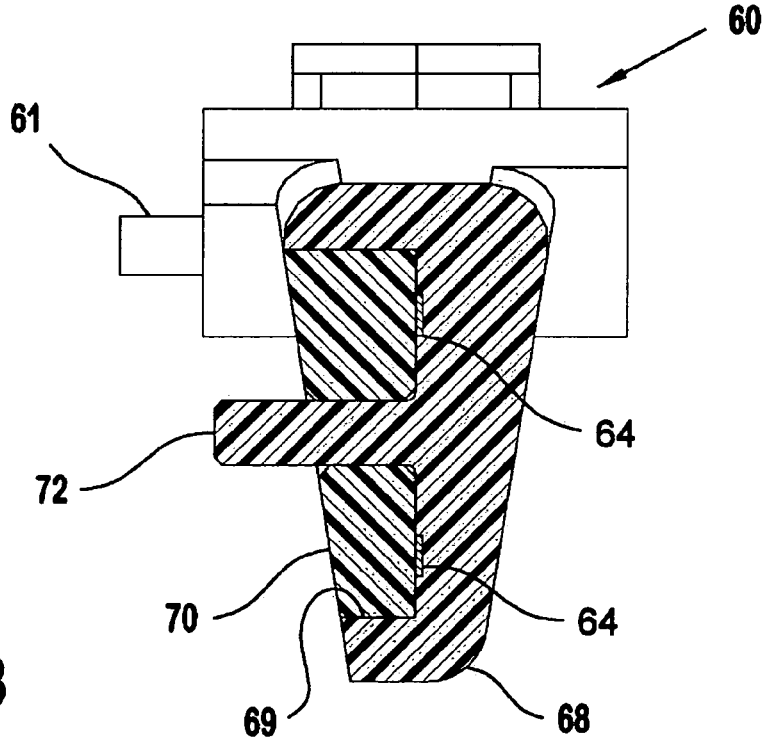
FIG. 8 is a cross-section of the tooth shown in FIG. 7.
Figure 9:
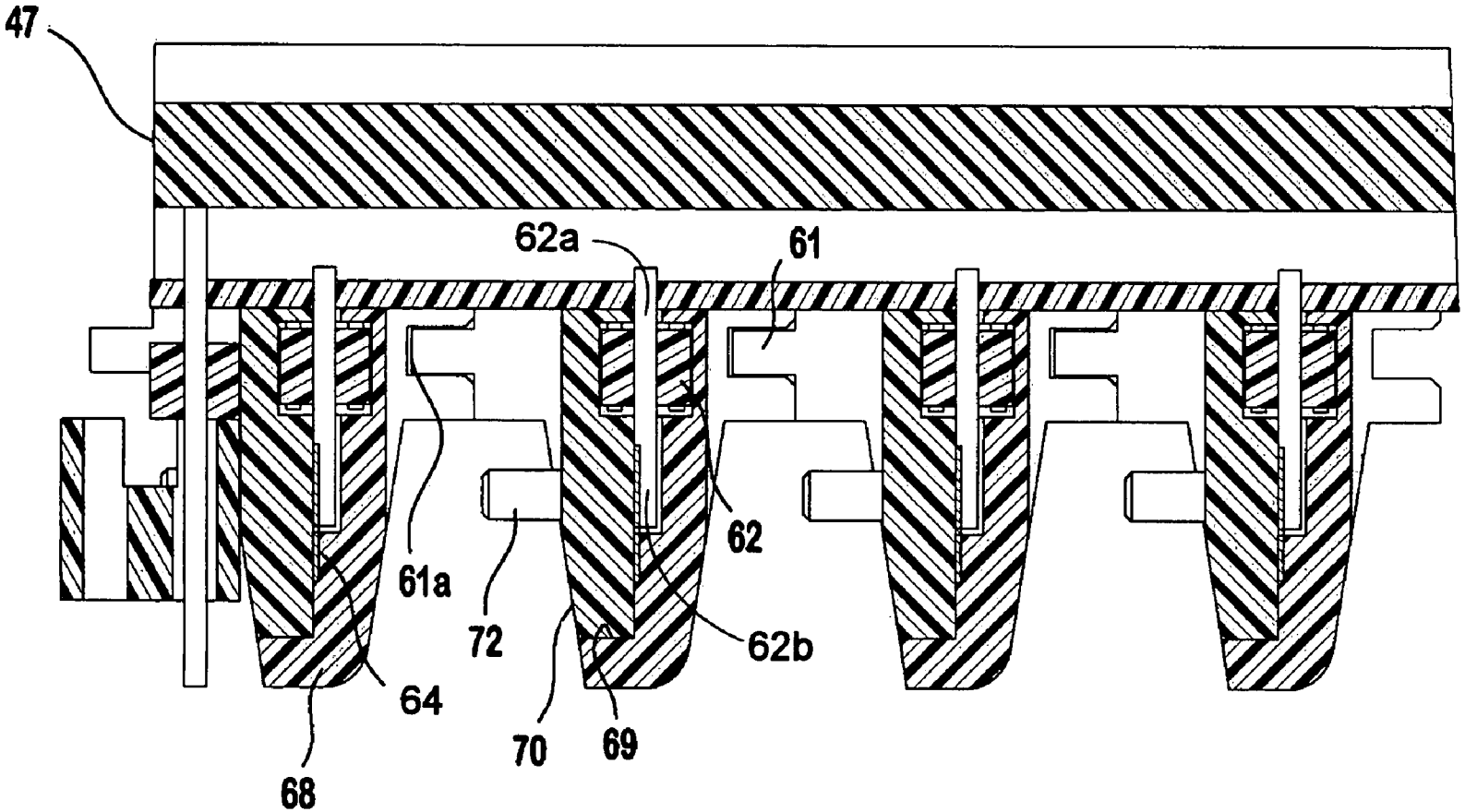
FIG. 9 is partial cross-section through the inventive combplate shown in FIG. 4.
Figure 10:
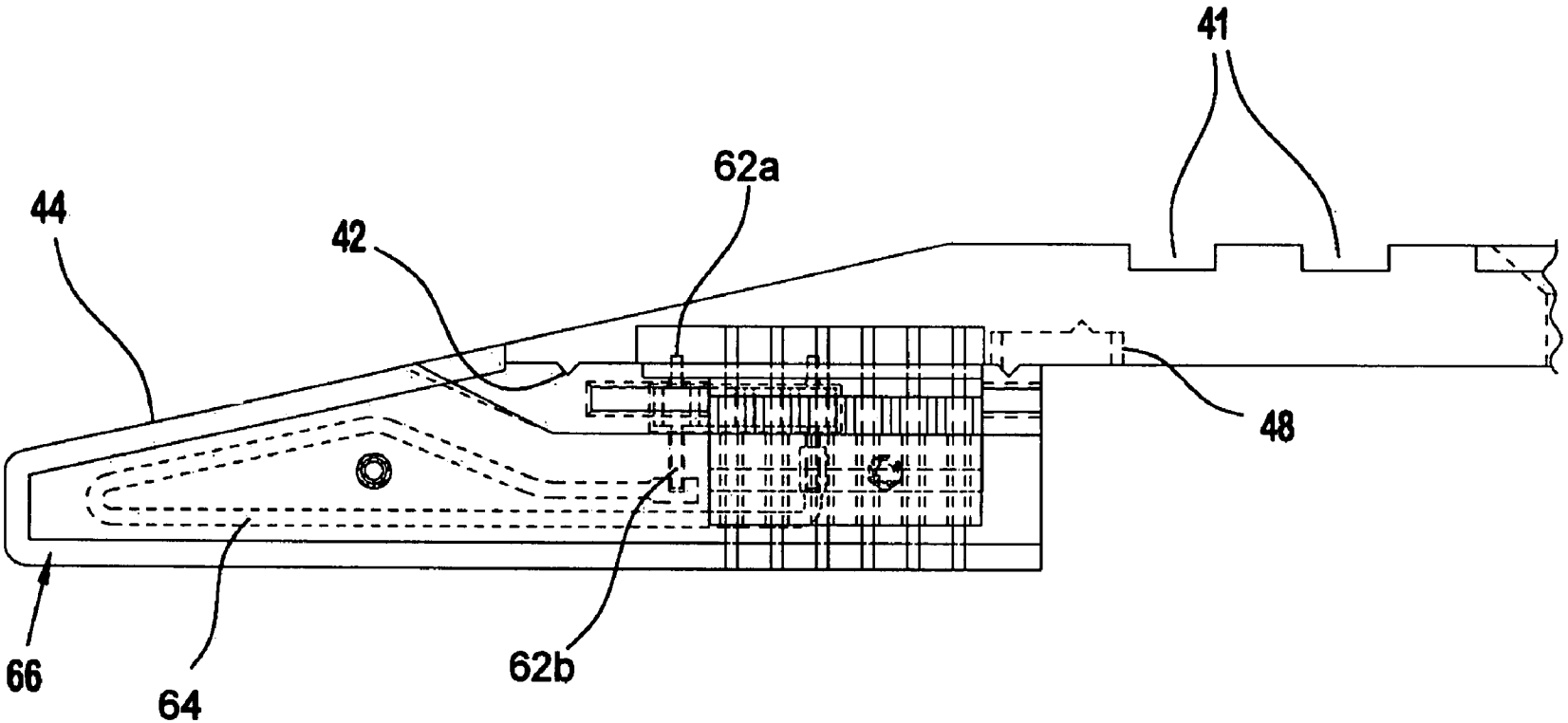
FIG. 10 is a side view of the inventive combplate.

FIGS. 4 and 7-10 show the teeth 60, which have an attachment portion 65 with a tab 67 that attaches to the slot 48 and elongated fingers 66 that align with and pass within the escalator step grooves 12 and between its guides 14 (step grooves 12 and guides 14 are shown in FIG. 3A). As shown in FIGS. 7-9, the teeth 60 are preferably made from two body parts 68 and 70. The first body part 68 has a cavity 69 that encloses the majority of the second body part 70. The tolerances between the cavity 69 and second body part 70 are such that the parts 68, 70 engage one another in a snap fit. Stakes 72, of which two are shown but of which three are preferable, extend through corresponding holes within the second body part 70. During final assembly, these stakes 72 are fused to permanently join the parts 68, 70 together. The advantage of this two body part assembly is that it presents no seam at a terminal portion; i.e., the portion of the teeth that engages the step grove 12 (FIG. 3A), opposing the direction of travel of the steps 202. Such a seam would present problems: first, the seam presents a line of weakness precisely at the point of most contact—a serious flaw, and second, the seam presents an edge that can catch a foreign object, again, precisely at the point most likely to catch such an object.

The teeth 60 engage the support plate 40, preferably at two points, and also engage each other side to side, to provide for tooth stability. First, as shown in FIG. 7, the teeth 60 have a tab 67 that engages the support plate slot 48. The tab 67 has an energy director 79 thereon that is used to fuse the tab 67 in the slot 48. Second, the teeth 60 have a relief 69 that engages the bottom portion of the slope 43. Adjacent teeth 60 also have a tooth interlock where protrusions 61 engage tooth cavities 61*a* (shown in FIG. 9). The two engagement points 67, 69 and adjacent tooth interlock 61 and 61*a* discourage the teeth 60 from being driven backwards when someone or something drives into them, as often happens when a person exists and escalator 200.

As shown in FIG. 8, the teeth 60 are electrically connected to the circuit board through the plug 62, which is stored in a cavity 98 in the first body part 68. The plug 62 has prongs 62*a* that engage a printed ink circuit detector 64, preferably printed on an interior surface of the second body part 70. The plug 62 also has prongs 62*a*, extending outside the tooth 60 that electrically connect to the communications circuit board 80.

The communications circuit board 80 is located within the support plate's recess 44, and has an end plug 82 at a terminal end thereof, that mates with an adjacent end plug (not shown) on an adjacent communications circuit board 80 in an adjacent support plate 40. The communications circuit boards 80 are preferably connected in series, because parallel connections would require a larger communications circuit board 80.

In operation, the escalator 200 has a processor (not shown) that detects an unsafe condition, as indicated by the breaking of a tooth 60. The processor constantly checks the communications circuit board circuits, which are engaged with the printed ink circuit to determine if there are any breaks, and if there are, where the breaks are. If the processor detects a break corresponding to an unsafe condition, the processor shuts down the escalator motor. The detection system can be programmed to shut down the motor for various unsafe conditions: the breaking of a single tooth 60, the breaking of adjacent teeth 60, the breaking of any two teeth 60, etc.

When the motor shuts down due to an unsafe condition, only the combplates 30 with broken teeth need to be removed, and only the broken teeth thereon need to be replaced, which makes for less costly and more efficient maintenance of broken teeth 60.

What is claimed is:

1. A fault detection combplate for closing the terminal ends of a continuous belt transport system comprised of grooved carrier plates the combplate comprising:

an elongated support body having first and second lateral edges and top and bottom surfaces, and a portion for attaching the combplate to a transport system;

a plurality of spaced apart projections, each of which is: shaped to align with and pass between the carrier plate grooves; provided with a detector that senses a break in its integrity and a circuit for communicating its status; and a communications board located within a recess of the combplate and in electrical contact with each of the projections for repeatedly monitoring the status of each projection to detect a break in a projection's integrity.

2. The combplate of claim 1, wherein the detector comprises a wire loop that extends through the projections and electrically connects to the communications board.

3. The combplate of claim 1, wherein the detector is a conductive ink.

4. The combplate of claim 1, wherein each of the projections comprises two parts, a first part being a body that defines a receiving cavity and a second part configured to be received in the cavity.

5. The combplate of claim 4, wherein the projections have a terminal end that exposes no seam facing a direction of motion of the carrier plates.

6. The combplate of claim 4, wherein the detector is located on the second part.

7. A combplate for a moving walkway or escalator having a plurality of moving plates, each plate comprising a plurality of grooves spaced from one another by guides, and a processor that recognizes an unsafe condition in the walkway or escalator, the combplate comprising:

a support plate having an elongated channel formed in a bottom surface thereof, and a receiving slot;

a plurality of teeth spaced apart and shaped to align with the moving plate's grooves, the teeth also aligning with the support plate receiving slot, each tooth comprising a detector; and a circuit board within the channel in electrical contact with the detector, wherein the circuit board is part of an electrical circuit comprising the processor.

8. The combplate of claim 7, wherein the detector is in contact with a wire that extends into the circuit board to form the electrical contact.

9. The combplate of claim 7, wherein the detector comprises a conductive ink circuit within the tooth.

10. The combplate of claim 9, wherein the unsafe condition detected by the processor corresponds to breaking the ink circuit.

11. The combplate of claim 10, wherein a predetermined number and locations of broken ink circuits define an unsafe condition, and the processor turns off a motor operating the escalator or walkway when the unsafe condition is detected.

12. The combplate of claim 7, each of the plurality of teeth comprises an elongated finger that extends within the groove and is located between the moving plates and the support plate.

13. The combplate of claim 12, wherein each of the plurality of teeth comprises a two part body, the first part comprising a cavity to receive the second part.

14. The combplate of claim 13, wherein the elongated finger has a terminal end that exposes no seam facing a direction of motion of the moving plates.

15. The combplate of claim 13, wherein the first part and second part are joined by a stake extending from the first part through the second part.

16. The combplate of claim 13, wherein the detector comprises a conductive ink circuit within the tooth.

17. The combplate of claim 16, wherein the conductive ink circuit is located on the second part.

18. The combplate of claim 7, wherein each tooth comprises an energy director that is used to sonically weld the tooth within the slot.

19. The combplate of claim 7, wherein the support plate comprises an energy director that is used to fuse the tooth to the support plate.

20. The combplate of claim 7, wherein the plurality of teeth engage each other through a mating protrusion and cavity, both located on adjacent teeth.

21. The combplate of claim 7, wherein the detector is in contact with a wire that extends into the circuit board to form the electrical contact.

22. A plurality of combplates for a moving walkway or escalator having a plurality of moving plates, each plate comprising a plurality of grooves spaced from one another by guides, and a detector that detects an unsafe condition in the walkway or escalator, each combplate comprising:

a support plate having an elongated channel formed in a bottom surface thereof, and a receiving slot;

a plurality of teeth spaced apart and shaped to align with the moving plate's grooves, the teeth also aligning with the support plate receiving slot, each tooth comprising a conductor; and a circuit board within the channel in electrical contact with the conductor;

wherein the plurality of combplates aligned next to one another across the escalator threshold, wherein adjacent combplates are electrically connected to each other, wherein the circuit boards are part of an electrical circuit comprising the detector.

23. The combplates of claim 22, wherein the circuit board spans a length of the support plate, and comprises electrical connectors at opposite ends that mate with adjacent circuit boards to form the electrical connection.

24. The combplates of claim 22, wherein a single combplate can be removed and replaced without requiring replacement of adjacent combplates.

* * * * *